United States Patent [19]

Kammerer

[11] 4,449,832

[45] May 22, 1984

[54] PROGRAM INPUT AND/OR TIME SETTING DEVICE

[75] Inventor: Gerd Kammerer, St. Georgen, Fed. Rep. of Germany

[73] Assignee: Dieter Graesslin Feinwerktechnik, Fed. Rep. of Germany

[21] Appl. No.: 359,036

[22] Filed: Mar. 17, 1982

[30] Foreign Application Priority Data

Mar. 20, 1981 [DE] Fed. Rep. of Germany ..... 3110947

[51] Int. Cl.[3] ..... G04C 9/00; G04B 29/00; G08C 9/08

[52] U.S. Cl. ..... 368/187; 368/321; 340/347 P

[58] Field of Search ..... 368/9, 62, 69–70, 368/72–74, 155–156, 185, 187, 306, 308, 319–321, 107–113; 340/347 P, 672, 347 AD

[56] References Cited

U.S. PATENT DOCUMENTS

| | | | |
|---|---|---|---|
| 3,612,393 | 10/1971 | Jones | 340/347 P |
| 4,031,386 | 6/1977 | Recker | 340/347 P |
| 4,091,612 | 5/1978 | Meisner et al. | 368/155 |
| 4,196,583 | 4/1980 | Komaki | 368/74 |
| 4,212,000 | 7/1980 | Yamada | 340/347 P |
| 4,263,590 | 4/1981 | Arnold et al. | 340/672 |
| 4,279,029 | 7/1981 | Oda et al. | 368/187 |
| 4,374,622 | 2/1983 | Kashio | 364/74 |

*Primary Examiner*—Vit W. Miska

*Attorney, Agent, or Firm*—Hill, Van Santen, Steadman & Simpson

[57] ABSTRACT

Manually actuatable means are provided for programming or time setting a digital-electronic time switch device which utilizes an analog program input eliminating the need for a separate data display terminal. The time setting system includes a manually adjustable dial assembly having at least one adjustable indicator arm movable about an annular time marking scale and connected through a train to a command encoder. The command encoder includes a wheel connected to the dial train for forward or backward rotation. The wheel is suitably constructed, such as by radial slits to code dial assembly settings for triggering a digital information transducer, such as an opto-electronic device, which signals an electronic counter. The electronic counter adjusts the device data memory by specific time units in relation to the digital information received by the command encoder. The dial assembly inherently indicates the adjusted time setting to the operator in readily observable analog form.

7 Claims, 4 Drawing Figures

PROGRAM INPUT AND/OR TIME SETTING DEVICE

BACKGROUND OF THE INVENTION

The invention relates to programming or time setting of a digital-electronic time switch device and, more particularly, is directed to a manual forward and backward rotatable command encoder for a data memory and an associated command input for controlling the encoder.

For time setting of a digital-electronic time switch device, the operator must program a time setting input manually in the form of an analog command which is converted to digital information for the device data memory. Heretofore, such switch clock devices have been set by the input of letters, numerals, and other characters at a terminal to the data memory via a pulse generator which can be manually controlled by selective rotation. The pulse generator emits counting pulses or coded commands when it is turned which form the input information supplied to the device data memory. The pulse commands are typically produced by electromechanical means in the form of make and break contacts or by electric eye means comprising a slotted disk passing through a light barrier. These known time setting systems require a data display terminal to set programming input, since the command encoder only emits individual, binary informational units controlled by virtue of the pulse counting rate and the relative forward or backward counting direction.

The present invention provides for a time setting system for use in a digital-electronic time switch device having an analog time setting input which inherently enables the operator to monitor the command information fed to the clock data memory. Thus, the heretofore typical input data display terminal and its associated mechanisms are not necessary and are eliminated.

SUMMARY OF THE INVENTION

For programming time setting of a digital-electronic time switch device, there is provided a dial which is manually adjustable with at least one selectively adjustable radial arm or pointer rotatable about the dial. The dial is positioned on a dial face annularly marked with individual time settings. The dial is connected through a suitable drive train, such as a shaft, to a command encoder wheel for emitting digital information based upon the dial setting analog command.

The command encoder may include a wheel constructed to emit individual, informational pulses or bits directly dependent upon the direction of rotation and the angle of rotation of the respective, corresponding dial pointer relative to the time scale set on the dial face. Particularly for use in a switch clock, the dial comprises two relatively adjustable pointer arms in the form of hour and minute hands. The time scale on the dial face can be divided into twelve hours, or into twenty-four hours, about the 360° circumference of the scale. There may also be provided a day scale corresponding to the days in a week for use with one pointer arm, while the other arm or arms are used to set the time of day in association with another scale or scales. The individual pointers or disk scales can be mechanically interengaged with one another via known clock gear trains, or the individual pointer or disk scales can be individually adjustable, or the pointers or disk scales can be uniformly adjustable based upon the movement of one of the pointers. Alternatively, week days may be set by means of a rotary switch or a slide switch, rather than a day scale disk connected to the dial train.

The invention affords a simple, inherently observable, and reliable time setting input for a digital-electronic device in an analog mode by means of pointers which relate to an accompanying dial scale face, whereby the dial setting is mechanically coupled to a digital command encoder which emits digital informational units dependent upon the dial position settings. The command encoder is in the form of a mechanical to electrical or electronic analog to digital converter for controlling the digital data clock memory. The dial face positions correspond to the information typically provided by an electronic-type data display terminal, such that the need for the typical electronic disply terminal for time setting is eliminated.

DESCRIPTION OF THE PREFERRED EMBODIMENTS

Figure 1:
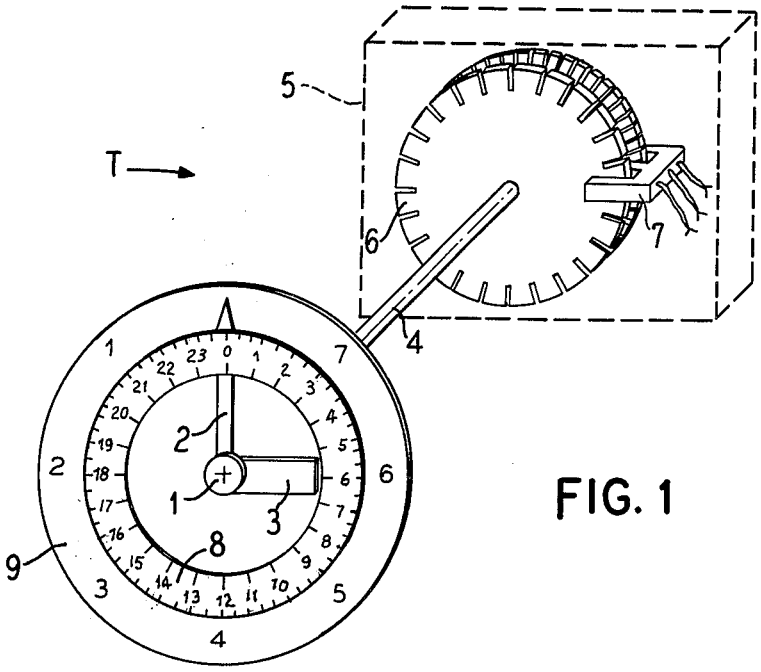
FIG. 1 is a schematic, perspective view of time setting system constructed in accordance with the present invention having an adjustable dial, a dial face, and a command encoder coupled to the dial.

FIG. 1 illustrates a programming or time setting system T for use in a digital-electronic time switch device constructed in accordance with the present invention. The system T includes a dial assembly 1 having a minute hand 2 and an hour hand 3 which are rotatable about the dial assembly axis and which can be coupled to one another by suitable, known mechanical gearing (not shown). The dial assembly 1 is connected through a drive train 4, in the form of concentric shafts respectfully associated with the dial hands, to a command encoder means 5. Here, the command encoder 5 is in the form of an electric eye or opto-electronic pulse generator comprising respective associated slotted disks 6 connected for rotation to the drive train shafts and a fork-shaped light barrier station 7 defining spaces into which the slotted disks are respectively received.

The dial assembly 1 is mounted on a dial face 8 having an annular scale of time of day markings with minute and hour divisions. The hour divisions may be divided between 0 and 12 or 0 and 24 throughout the 360° of the scale. It is further within the contemplation of the present invention to provide a further dial face 9 having an annular scale of week day markings, shown here as numbered between 0 and 7, which can be mechanically or electronically coupled via a similar dial train to the command encoder 5 for the purpose of programming week day input.

By means of manual, selective setting of the dial hands 2 and 3 on the associated dial face 8, individual binary information units are emitted by the command encoder 5, which acts as a transducer for setting of the time device. The informational units may amount to one minute per unit, set forward or backwards depending upon the relative rotation of the dial hands. These binary informational units are supplied as light pulses to an electronic counter which derives a time signal from the counter reading and then supplies this signal to a clock data memory from which time is set and ensues.

Figure 2:
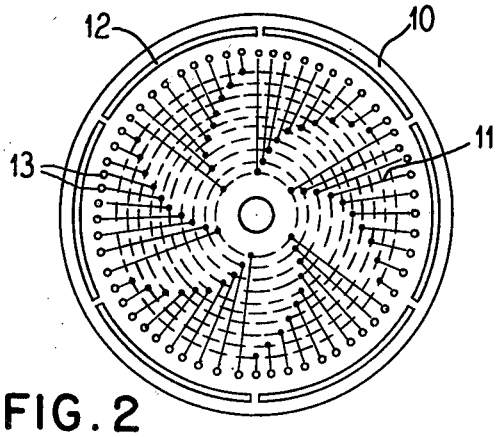
FIG. 2 is a schematic, side elevational view of a coding disk for use in a command encoder of FIG. 1 for translating a specific dial face setting into binary decimal code which can be supplied to the digital clock data memory.

The command encoder disk may also be used to translate specific dial settings relative to the dial face scales directly into a binary decimal code which can be supplied to the data memory when in the form of a special coding disk 10 as shown in FIG. 2. The coding disk 10 is stationary and formed with a printed circuit board coded on both sides having binary decimal code markings. In accordance with the preferred embodiment, the disk 10 contains ten concentrically arranged rings 11 for one through ten and an annularly subdivided outer ring 12 for one through six. Correspondingly installed contacts 13 are connected to the inside rings 11 and the outer ring portions 12 are sensed by suitable brushes (not shown) which are formed on or attached to the facing back surfaces of the dial indicator arms 2 and 3. After setting of the indicator arms 2 and 3 relative to the dial face 8, the set value is inscribed directly into the device data memory, either automatically by means of a suitable read setting program cycle or mechanically via suitable write key means. Similarly, specific week day information may be programmed on this type of coding disk as a result of relative placement of a week day pointer along a corresponding day scale 9.

The present invention is not limited to any particular form of coding means for transmitting information set by a dial analog. It is also possible that the indicators 2 and 3 can be set independently of one another, i.e., that these indicators are not mechanically coupled to one another, such that both indicators 2 and 3 can effect bit information on associated coding disks as shown in FIG. 2. The coding disk 10 may be arranged with a printed circuit board pattern enabling the minute hand 2 to proceed from one through sixty and enabling the hour hand 3 to proceed from one through twelve or from one to twenty-four.

In cases of a command encoder 5, as shown in FIG. 1, which emits binary informational units to an electronic counter, it is necessary that a zero setting operation be carried out when the device is placed into initial operation. This zero setting operation can be carried out automatically by providing for a range of informational units, relative to the time of day, between 0:00 and 23:59. During changeover of the time of day settings between 0:00 and 23:59, the current week day setting on a week day disk, if used, pends as constant information. The week disk can be set by hand or it may automatically be forwarded by one step during movement of the time of day dial setting between 23:59 and 0:00 by means of a suitable pawl and detent controlled stopping mechanism. Also, the week day disk may run on a printed circuit board like the coding disk 10 shown in FIG. 2 and be manually rotatable only in one direction.

Figure 3:
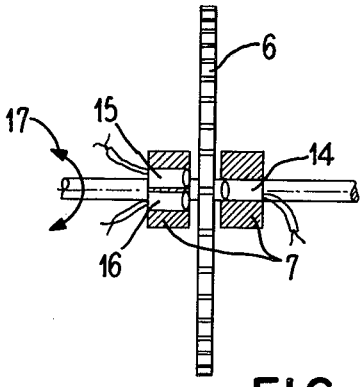
FIG. 3 is a schematic, partially broken away side elevational view of command encoder workings by which particular dial face setting information and forward or backward recognition of the input is discerned.

The electronic system for programming time setting information by either forward or backward rotation of one encoder disk 6, for use in the encoder arrangement of FIG. 1, is shown in FIG. 3. Opposed fork arms of the light barrier means 7 contain, on the one hand, a light transmitter 14 and, on the other hand, two juxtaposed light receivers 15 and 16. When the slotted disk 6 is moved or turned in one direction of the arrow 17, one light receiver, such as for example 15, is charged by the light transmitter 14 and the adjacent remaining light receiver, such as for example 16, is shaded When the slotted disk is turned in the opposite direction of rotation, the opposite result occurs. A suitable electronic counter can be correspondingly controlled to sense relative direction of rotation of the slotted disk 6 in this manner.

Figure 4:
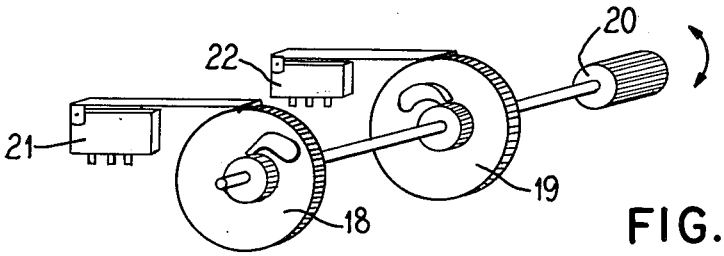
FIG. 4 is a schematic, perspective view of alternative command encoder workings in which mechanical means are used to detect dial setting information and forward or backward recognition of the input.

FIG. 4 illustrates a mechanical arrangement for converting dial settings into suitable signals for the device data memory alternative to that shown in FIG. 3. In place of one slotted disk 6, there is provided a pair of pulse generator wheels 18 and 19, respectively provided with oppositely directed ratchet and pawl locking mechanisms for enabling rotational movement of each corresponding wheel in a single direction. The wheels 18 and 19 are connected along a suitable driveshaft having a manual control knob 20 at one end for permitting programming of the angle and direction of rotation of the shaft. The locking mechanisms are provided with slip clutch means (not shown) such that when the shaft is turned in one direction only one of the wheels is rotated and when the shaft is turned in the other direction only the other wheel is rotated. Each of the wheels 18 and 19 is provided with an annular array of teeth or other trigger markings and suitable contact means 21 and 22 are respectively connected to the wheels 18 and 19 to supply signals to an electronic counter (not shown) depending upon the corresponding direction of rotation applied by the control knob 20.

It is further within the contemplation of the present invention that the time setting system may be provided with a fast and slow command format. Thus, for example, a suitable centrifugal governor means may be connected to the electronic counter so that the counter can be electrically switched to jump ahead or slowed down in the rate of change of the data memory given the manual setting speed effected at the dial assembly 1 or at the control knob 20. For example, given a slow rotation speed of time setting change, the binary informational units pass through the counter can correspond to one minute and, given a fast rotational speed, the binary informational units passing through the counter can correspond to ten minute intervals. It is also possible by virtue of a speed sensing format for the electronic counter to enable the counter to changeover automatically to different rates of time interval changes given specific, individual rotational speeds. It is also possible that only hours or only week days may be counted as soon as a certain rotational speed is exceeded at the time setting input, i.e., the dial assembly 1 or the control knob 20.

A manual, mechanical changeover of the counting rate for the electronic counter can also be effected by means of a suitable two-knob arrangement wherein the two control knobs are respectively, individually rotated by the operator to set the time. In this case, the two control knobs may be concentrically arranged relative to one another. A suitable draw-button circuit may also be used to effect such a manual, mechanical changeover of the counting rate.

The time setting system T of the present invention may be in the form of a modular component, making it possible to service a plurality of switch clock devices which are to be programmed with a uniform time setting. Such modularity would facilitate handling when a plurality of time switch devices are being used with an appropriate interface.

It is also within the contemplation of the present invention that the dial assembly 1 or control knob 20 for the time setting system to be adjusted and set with a precision motor means, such as a setting motor.

Although various minor modifications may be suggested by those versed in the art, it should be understood that I wish to embody within the scope of the patent warranted hereon all such modifications as reasonably and properly come within the scope of my contribution to the art.

I claim as my invention:

1. Apparatus for setting a digital-electronic time switch system comprising a command encoder means for emitting digital signals to a data memory means for controlling said time switch means, said command encoder means having transducer means for converting mechanical rotational movement in a forward or reverse direction into digital signals, and an adjustable dial assembly comprising a dial face formed with an annular time scale, at least one dial arm means selectively rotatable in forward and reverse directions about said dial face, and a train means mechanically connecting said dial arm means and said transducer means for varying the digital signals to said data memory, said transducer means comprising a rotatable slotted disk, a light barrier means for receiving an annular edge of said disk and generating light pulses by passage of said disk slots therethrough, and a pulse counter means connected to said light barrier means for converting said light pulses into digital signals and said light barrier means having a fork-shaped housing portion defining an opening through which said disk slots are passed, one arm of said housing portion containing a light transmitter and the other arm of said housing portion containing a pair of adjacent receivers for intercepting light from said transmitter passed through said disk slots, such that when one receiver is engaged by light from said transmitter the other receiver is shaded by said disk enabling said light barrier means to discern relative direction of movement of said disk.

2. The apparatus of claim 1, wherein said light pulses represent individual, specific time intervals.

3. The apparatus of claim 1, wherein said dial arm means are manually adjustable.

4. The apparatus of claim 1, wherein said command encoder means and said dial assembly is in the form of a modular unit.

5. The apparatus of claim 1, wherein said dial assembly comprises a plurality of said dial arm means each respectively associated with one said train means and one said transducer means.

6. Apparatus for setting a digitalelectronic time switch system comprising a command encoder means for emitting digital signals to a data memory means for controlling said time switch means, said command encoder means having transducer means for converting mechanical rotational movement in a forward or reverse direction into digital signals, and an adjustable dial assembly comprising a dial face formed with an annular time scale, at least one dial arm means selectively rotatable in forward and reverse directions about said dial face, and a train means mechanically connecting said dial arm means and said transducer means for varying the digital signals to said data memory, wherein said transducer means comprises two pulse generator wheels disposed for rotation on a common shaft, each wheel being formed with respective direction locking means such that each wheel is only rotatable in a direction opposite of the other, and electromechanical contact means respectively associated with each wheel for emitting pulse signals upon rotation of said each wheel, and said train means comprises a control knob connected to said common shaft.

7. The apparatus of claim 6, wherein said pulse signals represent individual, specific time intervals.

* * * * *